US005320290A

United States Patent [19]

Rohs et al.

[11] Patent Number: 5,320,290

[45] Date of Patent: Jun. 14, 1994

[54] INJECTION NOZZLE FOR LIQUID MEDIA

[75] Inventors: Ulrich Rohs, Düren; Heinrich Jeuken, Aachen, both of Fed. Rep. of Germany

[73] Assignee: Calsim Gesellschaft fur Simulationstechnik mbH, Aachen, Fed. Rep. of Germany

[21] Appl. No.: 55,673

[22] Filed: Apr. 29, 1993

[30] Foreign Application Priority Data

May 8, 1992 [DE] Fed. Rep. of Germany ..... 4215122

[51] Int. Cl.[5] ..... B05B 1/26

[52] U.S. Cl. ..... 239/493; 239/124; 239/596

[58] Field of Search ..... 239/596, 491, 492, 493, 239/494, 124, 533.12

[56] References Cited

U.S. PATENT DOCUMENTS 2,514,581 7/1950 Janssen ..... 239/494
3,532,271 10/1970 Polnauer ..... 239/492
4,013,229 3/1977 Rohs ..... 239/493

FOREIGN PATENT DOCUMENTS 2407856 8/1975 Fed. Rep. of Germany .
0144012 12/1978 Japan ..... 239/596

*Primary Examiner*—Andres Kashnikow
*Assistant Examiner*—Christopher G. Trainor
*Attorney, Agent, or Firm*—Collard & Roe

[57] ABSTRACT

Injection nozzle for liquid media, with a nozzle body with an inlet duct and swirl ducts connected thereto and tangentially directed into a turbulence space, as well as with a return duct, whereby the turbulence space is substantially formed by an annular groove in the face side of the nozzle on the outlet side. There is a cover plate fastened thereon and provided with a central outlet opening, and the cover plate forms with the nozzle core a disk-shaped narrow gap. Thus, the nozzle body has in its face surface on the outlet side a central depression for receiving and locking into place the cover plate, whose diameter is smaller than the diameter of the nozzle body. The depth of the depression is smaller than the thickness of the cover plate, and the cover plate is seated on a collar of the nozzle casing enclosing the nozzle body.

6 Claims, 1 Drawing Sheet

FIG. 1
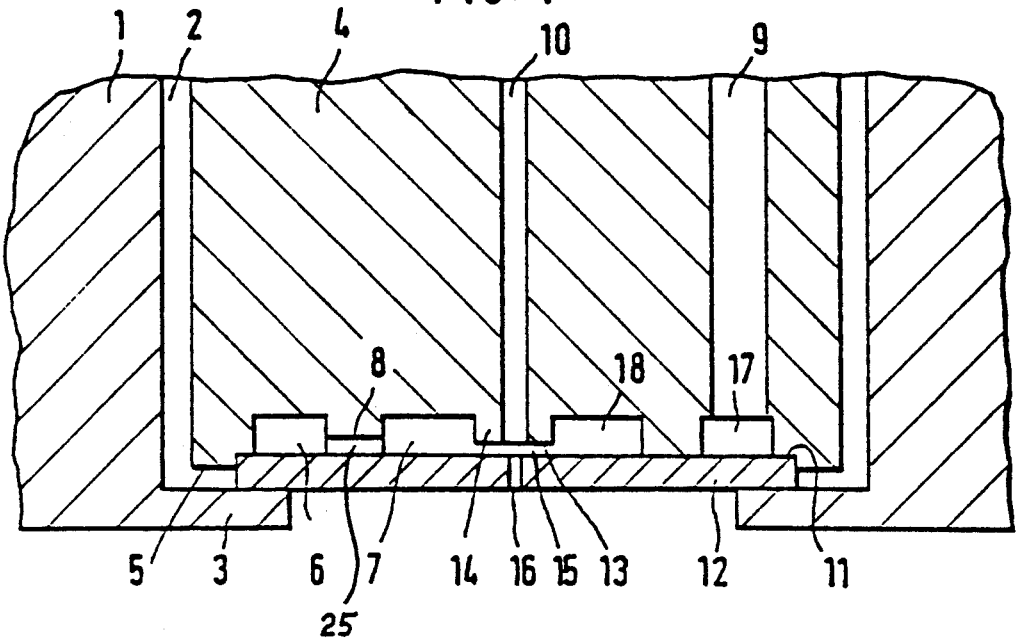
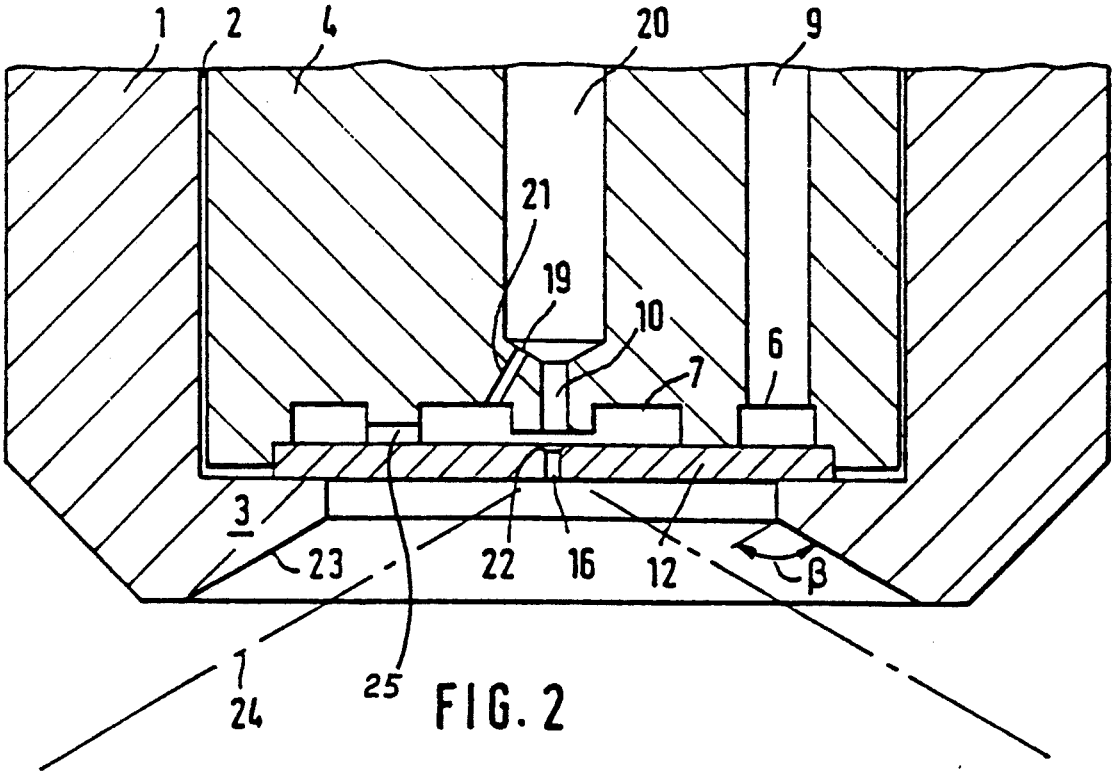
FIG. 2

INJECTION NOZZLE FOR LIQUID MEDIA

BACKGROUND OF THE INVENTION

1. Field of the Invention

The present invention relates to an injection nozzle for liquid media, in particular fuels.

2. The Prior Art

A prior art injection nozzle is known from DE 2,407,856 C3 and is capable of injecting quantities of liquids ranging from 0.05 to 10 kg/h. The increasing demands with respect to keeping the environment clean, as well as the economy of combustion systems and engines, makes it necessary to further reduce the injection quantities to extremely low values. In this connection, it is very important that the injection jet is formed very exactly, which in turn requires a very exact manufacture.

It has been found that with different tolerances, the simple installation of the cover plate and nozzle body fastened thereon has led to considerable malfunctioning in the injection behavior of the nozzle and has led to repeated difficulty with each installation and removal of the nozzle. Acceptable injection behavior of the nozzle requires an extremely exact alignment of the injection ducts and outlet opening, as well as a very exact centering of the outlet opening with respect to the turbulence chamber in order to avoid a deflection of the spray jet.

SUMMARY OF THE INVENTION

It is an object of the present invention to provide an injection nozzle having improved injection accuracy.

The injection nozzle according to the present invention overcomes the deficiencies in the prior art by providing that the diameter of the cover plate is smaller than the diameter of the nozzle body; that the nozzle body has in its face surface on the outlet side a central depression or recess for receiving the cover plate in a locked manner; and that the depth of the depression or recess is smaller than the thickness of the cover plate. Thereby it is assumed that the cover plate is kept exactly centered relative to the turbulence chamber or spinning chamber and that a deflection of the spray jet due to lack of centering of the outlet opening with respect to the turbulence chamber is thereby avoided.

The injection medium enters the turbulence chamber or spinning chamber under high pressure, and experiences there an increased turbulence swirl. It then flows at high pressure through the disk-shaped gap between the nozzle core, which is surrounded by the turbulence chamber, and the cover plate. The injection medium, with maximum acceleration, then enters from all sides directly into the outlet opening, where the atomization takes place.

However, this applies only to the theoretical case wherein the feeding in of the injection medium takes place from all sides with the same intensity, quantity and rate, which is not realizable with small dimensions in the $\mu$-range. The consequences are large deformations of the form of the spray jet.

In a further embodiment of the injection nozzle of the invention, the central outlet opening of the cover plate has on the inlet side a depression or recess which has a thickness that is substantially equal to the thickness of the cover plate. Even with small possible dimensions, the depression forms a still zone for the inflowing injection medium, which zone extends in the direction of spray outflow.

According to the invention, the spray outflow is enhanced. Furthermore, the outlet side of the collar of the nozzle casing, which supports the cover plate, forms a conical opening for the spray outflow, and the conical opening having an angle greater than 100°. With the known prior art injection nozzle, it is possible that a vacuum may form on the boundary layer of the jet spray, causing the deposition of a film of the injection medium around and onto the outlet opening. The jet spray is thereby detrimentally influenced as well, e.g., deflected. This prior art disadvantage is avoided by the nozzle according to the invention, whereby the vacuum which occurs also aspirates a sufficient amount of air into the boundary layer and thus contributes to the self-cleaning of the injection nozzle. Thus, the nozzle of the invention permits a very broad range of control for the fluid flow, with extremely low quantities of deflected spray outflow.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, wherein similar reference characters denote similar elements throughout the views:

FIG. 1 shows a cross section through the lower part of an injection nozzle according to the invention; and FIG. 2 shows a cross section through a part of another embodiment of the injection nozzle of the invention.

DETAILED DESCRIPTION OF PREFERRED EMBODIMENTS

Turning now in detail to the drawings, FIG. 1 shows the lower part of an injection nozzle for a liquid medium, for example fuel, with a nozzle casing 1 having a central bore 2, of which the diameter is reduced by a collar 3 at its outlet end.

A cylindrical nozzle body 4 is arranged on top of collar 3. The nozzle body 4 has several concentric grooves 6, 7 provided in its lower face side 5, which grooves are connected with one another by tangential swirl ducts or spin channels 25 in the bridge 8 present between the grooves 6 and 7. A feed duct 9 for the injection medium extends through the nozzle body 4 and feeds into the outer groove 6.

Furthermore, the nozzle body 4 has a central return duct 10.

The lower face side 5 of the nozzle body 4, furthermore, has a central depression or recess 11 for receiving and for locking into place a part of the thickness of a cover plate 12. The cover plate covers grooves 6 and 7. With the face surface 13 of the nozzle core 14, which core is surrounded by the groove 7, the cover plate 12 forms a disk-shaped gap 15. Gap 15 has a surrounding surface substantially smaller than the cross-section of a central outlet opening 16 in the cover plate 12. Moreover, the cover plate 12 forms with the groove 6 a receiving chamber, and forms with the groove 7 a turbulence chamber or spinning chamber 18 for the injection medium.

The cover plate 12 has a thickness of a few microns, and advantageously comprises an elastic material, for example spring steel. The cover plate 12 is not shown in a true scale. Cover plate 12 is capable of coming to rest on the face side 13 of the nozzle core 14 in such a way that the thickness of the disk-shaped gap 15 is practically equal to zero in the resting position, and this thickness increases by a minor amount only with corresponding injection pressure.

The depression or recess 11 in the nozzle body 4 assures a perfect central positioning of the cover plate 12 in relation to the turbulence chamber or spinning chamber 18 and prevents inaccuracy that might result from the tolerance between the nozzle casing 1 and the nozzle body 4.

FIG. 2 shows another embodiment for the injection nozzle according to the invention, whereby those parts corresponding to FIG. 1 have the same reference numerals and are not described again.

FIG. 2 shows that the return duct 10 is spaced a larger distance from the face side 13 of the nozzle core 14. An injector duct 21 starting from the turbulence chamber or spinning chamber 18 feeds into the transition point 19 to the larger diameter 20. The diameter of the injector duct 21 is much smaller than the diameter of the widened part 20 of the return duct 10. This permits a particularly favorable return of the unused injection material. However, the injector duct 21 is not necessarily required in view of the other features of this exemplified embodiment which differ from FIG. 1.

At its side facing the nozzle core 14, the outlet opening 16 in the cover plate 12 has a depression or chambering 22. This depression forms a still space for the injected material arriving under high acceleration through the disk-shaped gap 15, even if the injected material is fed from all sides from the turbulence space at different rates or in different quantities. In this way, deformation or deflection of the spray jet is avoided in that the injected material exits with a pressure that is evenly distributed across the entire cross section of the outlet opening 16.

FIG. 2 shows, furthermore, that the collar 3 of the nozzle casing 1 has a conical depression or recess forming a conical opening 23 for the spray outflow whose opening angle $\beta$ is greater than 100°.

The effect of this nozzle structure of the invention is that air is aspirated along the conical boundary layer 24 of the spray jet. This air moves along the wall of the spray outflow opening 23 up to the outlet opening 16 and prevents the deposit of an interfering film of the injected material. Such a film would deflect the jet spray and change the outlet opening. Hence, the nozzle embodiment effects at the same time a self-cleaning of the injection nozzle.

While two embodiments of the present invention have been shown and described, it is to be understood that many changes and modifications may be made thereunto without departing from the spirit and scope of the invention as defined in the appended claims.

What is claimed is:

1. The injection nozzle for liquid media comprising a nozzle body with an inlet duct and spin channels connected thereto and tangentially directed into a spinning chamber, said nozzle body having a nozzle core having a central return duct arranged in the nozzle core, said nozzle body having a face side, said spinning chamber substantially formed by an annular groove in the face side of the nozzle body;

a cover plate fastened on said nozzle body and provided with a central outlet opening, said cover plate forming with the nozzle core a disk-shaped gap connecting the spinning chamber with the central outlet opening of the cover plate, on the one side, and with the central return duct on the other side;

said central outlet opening having a cross section which is larger than the surrounding surface of the disk-shaped gap;

said cover plate seated on a collar of the nozzle casing enclosing the nozzle body; and said cover plate having a diameter and said nozzle body having a diameter, the diameter of the cover plate being smaller than the diameter of the nozzle body, said nozzle body having in its face side a central recess for receiving the cover plate and for locking the cover plate into position, said recess having a depth and said cover plate having a thickness, and the depth of said recess being smaller than the thickness of the cover plate.

2. Injection nozzle according to claim 1, wherein the central outlet opening of the cover plate has on its inlet side a chamfering.

3. Injection nozzle according to claim 1, wherein the outlet side of the collar of the nozzle casing supporting said cover plate forms a conical opening for the spray outflow, said conical opening having an angle $\beta$ which is greater than 100°.

4. An injection nozzle for liquids, said injection nozzle comprising a nozzle body having a discharge end, a cover plate opposing said nozzle body discharge end, said discharge end being configured to define a central core having an endsurface, said cover plate having an exhaust orifice therethrough in alignment with said core, said core end surface being of a greater size than said exhaust orifice and completely overlying said exhaust orifice; an annular recess in said nozzle body surrounding said core and together with said cover plate defining a spinning chamber; an inlet channel disposed outwardly of said spinning chamber, said inlet channel being defined by a recess in said nozzle body with said recess being closed by said cover plate,and spin channels extending from said inlet channel substantially tangentially into said spinning chamber above said cover plate; said cover plate being permanently spaced from said core end surface and defining between said cover plate and said core end surface a narrow gap through which the liquid being injected passes from said spinning chamber into said exhaust orifice, said spin channels discharging into said spinning chamber substantially at the level of said gap, and said gap having a flow section at the periphery of said core materially less than the cross section of said exhaust orifice;

said cover plate seated on the collar of the nozzle casing enclosing the nozzle body; and said cover plate having a diameter and said nozzle body having a diameter, the diameter of the cover plate being smaller than the diameter of the nozzle body, said nozzle body having in the discharge end a central recess for receiving the cover plate and for locking the cover plate into position, said recess having a depth and said cover plate having a thickness, and the depth of said recess being smaller than the thickness of the cover plate.

5. Injection nozzle according to claim 4, wherein the central outlet opening of the cover plate has on its inlet side a chamfering.

6. Injection nozzle according to claim 4, wherein the outlet side of the collar of the nozzle casing supporting said cover plate forms a conical opening for the spray outflow, said conical opening having an angle $\beta$ which is greater than 100°.

* * * * *